US005400732A

United States Patent [19]

Berge

[11] Patent Number: 5,400,732

[45] Date of Patent: Mar. 28, 1995

[54] PROCESS AND SYSTEM FOR GUIDING AND SUBMERGING A PUMP AGGREGATE IN A TANK FLUID IN A TANK

[75] Inventor: Magne O. Berge, Paradis, Norway

[73] Assignee: Framo Development A/S, Helldal, Norway

[21] Appl. No.: 958,349

[22] PCT Filed: Jun. 28, 1991

[86] PCT No.: PCT/NO91/00094

§ 371 Date: Dec. 17, 1992

§ 102(e) Date: Dec. 17, 1992

[87] PCT Pub. No.: WO92/00872

PCT Pub. Date: Jan. 23, 1992

[30] Foreign Application Priority Data

Jul. 3, 1990 [NO] Norway ..... 902959

[51] Int. Cl.[6] ..... B63B 25/00

[52] U.S. Cl. ..... 114/74 R

[58] Field of Search ..... 114/74 A, 74 R, 74 T, 114/75, 76, 221 R, 222; 220/562, 500, 221, 222; 137/565, 590; 417/902, 572

[56] References Cited

U.S. PATENT DOCUMENTS 3,859,944 1/1975 Warner ..... 114/74 R
5,095,836 3/1992 Gallagher ..... 114/72
5,119,749 6/1992 Velleca et al. ..... 114/74 T
5,203,828 4/1993 Strain ..... 114/74 R

FOREIGN PATENT DOCUMENTS 0123631 12/1971 Norway .
0432397 4/1984 Sweden .
8405461 10/1985 Sweden .
1405175 9/1975 United Kingdom .

*Primary Examiner*—Stephen P. Avila
*Attorney, Agent, or Firm*—Francis C. Hand

[57] ABSTRACT

A pump aggregate is mounted within a bell shape housing member along with a hoisting winch which permits the lowering of the pump aggregate into a hatch of a cargo tank when a hatch cover has been removed. The housing member allows the passage of the pump aggregate into the hatch while maintaining the pressurized conditions of the hatch. A hose stump is disposed in folded manner within the housing member to unfold during lowering of the pump aggregate. The hose stump connects to a coupling on the top of the housing member. A pair of flexible hydraulic conduits which are connected to the pump aggregate also uncoil during lowering of the pump aggregate and, in turn, are connected to coupling arrangements on the housing member. A seal is provided about the open bottom of the housing member to seal against a tank to maintain the pressurized conditions.

9 Claims, 5 Drawing Sheets

PROCESS AND SYSTEM FOR GUIDING AND SUBMERGING A PUMP AGGREGATE IN A TANK FLUID IN A TANK

This invention relates to a process and system for guiding and submerging a pump aggregate in a tank fluid in a tank.

As is known, various types of arrangements have been employed for deploying pump aggregates into a tank such as a cargo tank of an oil tanker or the like.

For example, published Swedish patent application 8405461 describes a system which employs a mobile pump aggregate in combination with a mobile sluice arrangement. As described, the sluice arrangement is constructed so as to be placed over a hatch of a tanker while the pump aggregate is separately mounted over the sluice arrangement. The purpose of the construction is to introduce the pump aggregate into the hatch in a pressure-sealed and gas-sealed manner. However, as described, the pump aggregate is suspended by means of a hoisting rope which passes through a wall of the pump aggregate. In addition, various hydraulic medium stumps are required in the housing surrounding the pump aggregate in order to deliver hydraulic fluid to and from the pump aggregate in order to drive a motor therein. As a result, expensive seals are required in order to allow the stumps and the hoisting rope to be passed through the walls of the pump aggregate housing in order to separate the atmospheric pressure externally of the sluice arrangement from the non-atmospheric pressure existing internally of the sluice arrangement.

It is also known from Swedish Patent 432,397 to utilize a mobile sluice arrangement with a bellows-formed guide member received in the same sluice housing. The guide member is fastened in place in the sluice arrangement and is sluiced into the tank in a gas-sealed manner and forms a provisional, "water lock"-forming sluice extension submerged in the cargo. After the sluice housing is removed, the pump can be lowered in open air via the sluice extension down in the cargo.

From NO 123,631 a sluice arrangement is known having an associated sluice valve permanently fastened at a hatch opening, the sluice valve replacing the usual hatch cover. A hoisting winch is arranged on the outside of the housing member of the sluice arrangement.

Accordingly, it is an object of the invention to provide a simplified arrangement of mobile sluice arrangement and pump aggregate for tanks.

It is another object of the invention to provide a simplified arrangement for deploying a pump aggregate in a hatch of a cargo tanker.

It is another object of the invention to be able to readily submerge a pump aggregate in a hatch under pressure.

Briefly, the invention provides a mobile pump aggregate in combination with a mobile sluice arrangement, where the pump aggregate can be introduced into cargo in a pressure-sealed and gas-sealed, accurately controlled manner. In most cases, the tank in question has a pressure which differs from atmospheric pressure. In other words, the tank shall normally have a certain excess pressure, specifically in order to counteract air from penetrating into the tank space, by pressurizing the tank neutral gas with a certain excess (total pressure of about 1.15 bar). In particular instances, for example in connection with a ship's tank on leakage of tank fluid via holes at the bottom or lower side portions of the tank, for example as a consequence of running aground, there can arise however momentarily a diminished pressure in the tank.

Accordingly, to the invention the aim is a process with which the pump aggregate can be guided down in the fluid of the tank without affecting to an essential degree the pressure which prevails in the tank. In particular, the aim is to be able to guide the pump aggregate down in the tank in a situation with significantly diminished pressure occurring which is produced as a result of leakage in the tank and especially a momentary leakage.

On lowering the pump aggregate in the residual tank fluid, there is the possibility of transferring the tank fluid from the damaged tank to for example an available ballast tank, without risking additional leakage of the tank fluid. If necessary, such amount of tank fluid will be able to be transferred from the damaged tank that a water plug is formed in the tank and thereby not only can additional leakage of tank fluid be prevented, but also the tank fluid can stabilize in the tank by the supply of extra amounts of neutral gas, in such manner that undesired evaporation or degassing from the tank fluid can be prevented over time.

According to the invention, the process can be employed in connection with ships' tanks which are placed under excess pressure with a layer of neutral gas over the tank fluid and which during running aground or other damage to the tank are subjected to a diminished pressure as a consequence of leakage of the tank fluid. When tank fluid is mentioned herein it is especially oil cargo one thinks about, but also other cargos can be of interest, without concrete examples of such cargos being disclosed herein.

Where reference is made herein to tanks, this applies as mentioned especially to ships' tanks, but also other tanks, such as land tanks.

On board modern tankers, it is usual to employ pump aggregates consisting of unloading and loading pumps with an associated drive motor and the like, which are permanently submerged in the cargo tank and which have an intake of the pump arranged at the deepest level of the ship's tank (cistern). In certain cases, such as on running aground or on other damage occurring to the cargo tank, one can obviously employ such permanently submerged pumps in connection with pumping of cargo from the damaged cargo tank to a ballast tank or another suitable location. In most cases of running aground, there will however be little practical use in pumping of the cargo from cargo tank to ballast tank with such a permanently submerged pump. Generally, emptying of cargo on leakage after running aground will normally happen rather momentarily with a definite amount of leakage. Thereafter, the cargo level will be stabilized and balanced against external water pressure and thereby be held more or less stable at one and the same level. Gradually, as portions of the residual cargo are pumped out of the damaged cargo tank, this will involve a substantially corresponding amount of water penetrating the tank. These amounts of water will then be rapidly collected at the deepest portion of the ship's tank. The result will then be that the pump aggregates, which are permanently submerged in the bottom of the tank, will pump water to the ballast tank instead of the residual cargo.

Mobile pump aggregates can be utilized in a crisis situation instead of or in addition to possible permanently submerged pumps.

In connection with damage which occurs to the tank, the use of the pump aggregate in the above manner will prevent to a large extent unnecessary leakage of tank fluid from the tank, at the same time as counteracting air entering the tank and in all instances penetration of air in the tank is limited during introduction of the aggregate of drive motor and pump in the tank.

The process is characterized in that a pump aggregate is suspended in advance in The sluice arrangement via an associated hoisting winch which is fastened internally in the sluice arrangement, after which by communication between the tank and the sluice arrangement via a pressure regulating valve in the hatch cover, the pressure between the tank and the sluice arrangement is balanced and simultaneously an extra sealing pressure is established in the seal between the sluice arrangement and the tank, and thereafter the hatch opening is uncovered in an open position within the sluice arrangement and the pump aggregate is introduced via the hoisting winch into the tank and is submerged in the tank fluid.

Thus, one has the possibility to ensure in an especially rapid manner a simple sluicing of the pump aggregate inwardly into the tank with an effective gas sealing and pressure sealing, in an easily controllable manner by way of simple means.

The invention provides a system for gas-tight and pressure-tight guiding down of a mobile pump aggregate having a drive motor with associated drive force conduits and a pump with associated pump medium hose by means of a sluice arrangement via a hatch opening in a tank, which has a pressure differing from atmospheric pressure, and also submerging of the pump aggregate in the tank fluid. The sluice arrangement comprises a support means, with an associated seal for sealing off against the tank. By means of a hoisting winch the pump aggregate received in the sluice arrangement is sluiced in a gas-tight and pressure-tight manner via an uncovered hatch opening into the interior of the tank.

The system according to the invention is characterized in that a closing valve is arranged for intermittent closing off of the pump medium hose stump relative to the outer side of the sluice arrangement, that an actuating means is arranged in combination with the sluice arrangement for actuating a pressure-regulating valve on the hatch cover from the outer side of the sluice arrangement for opening a flow connection between the tank and the sluice arrangement, that there is arranged in combination with the sluice arrangement a device which is operated from the outer side of the sluice arrangement for removing the hatch cover from the hatch opening for uncovering an access opening to the interior of the tank, and that the hoisting winch is received internally in the sluice arrangement and is adapted to position the pump aggregate in the tank by means of a drive means actuatable from the outer side of the sluice arrangement.

With a relatively simple arrangement of sluice arrangement, pressure-balancing valve or closing valve and device for removing the hatch cover from the hatch opening one can ensure a controlled guiding down of the pump aggregate in the tank fluid, without substantial pressure changes in the tank and without producing substantial additional leakage of tank fluid.

A support means according to the invention, for a pump aggregate of drive motor and pump with accessories, including drive force conduits and pump hose, for guiding down of the pump aggregate via a hatch opening in a tank and also submerging of the pump aggregate in the tank fluid, is provided with a hoisting winch for lowering of the aggregate relative to the support means and is in the form of a bell-shaped housing member with closed side walls and closed top together with an open bottom.

The support means is characterized in that the bell-shaped housing member of the support means surrounds the hoisting winch and associated pump aggregate of drive motor and pump and associated conduit stumps and hose stump at a level above the lower opening of the housing member, the pump aggregate being suspended in the housing member via the hoisting winch, while the associated drive force conduit stumps and pump medium hose stump are connected at the one end up to the motor and the pump respectively and at the other end up to coupling means on the outer side of the sluice arrangement and are folded together in the housing member and made ready for putting out from the housing member together with the aggregate of drive motor and pump.

Further features of the invention will be evident from the following description of the invention having regard to the accompanying drawings in which.

Figure 1:
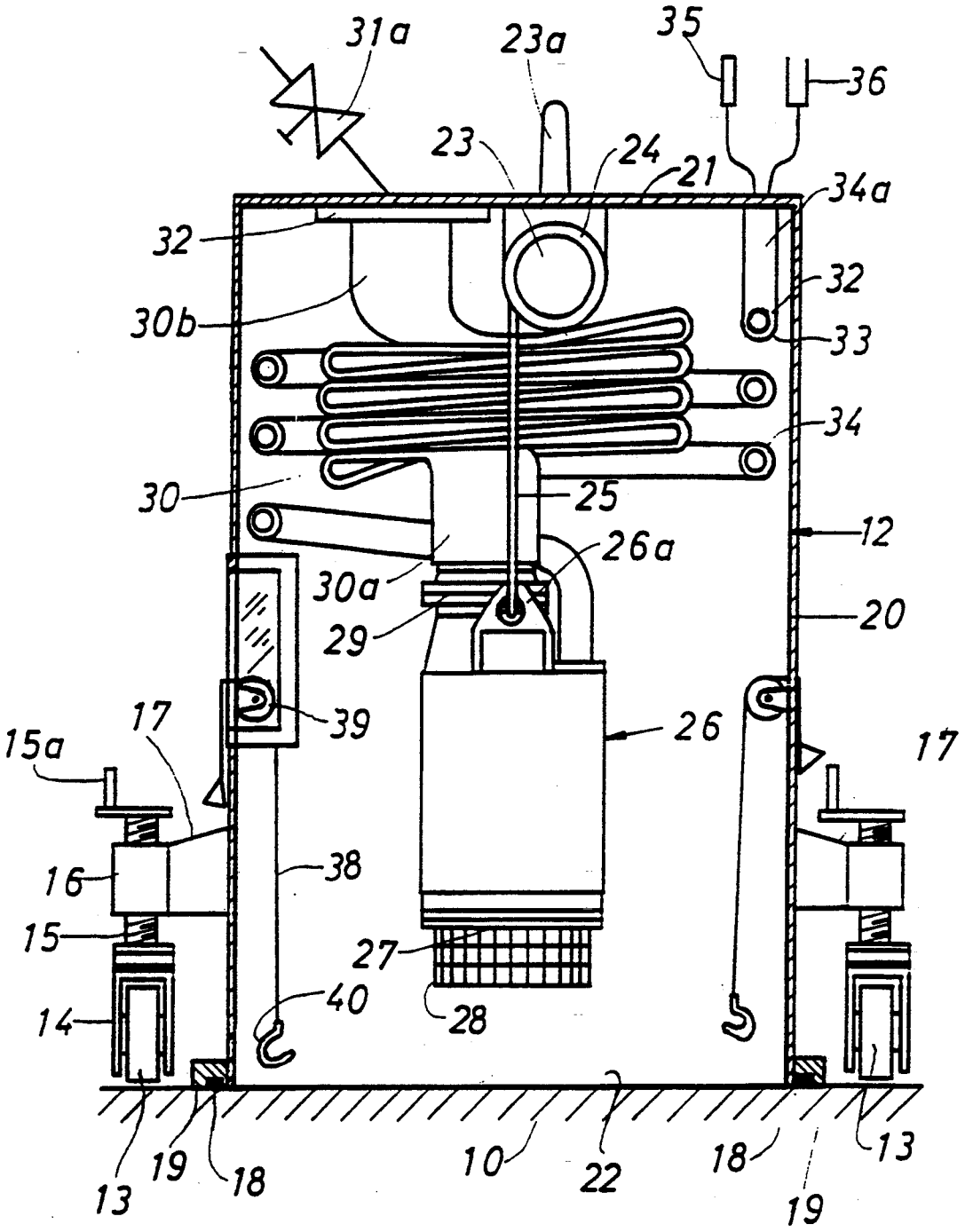
FIG. 1 show a support means according to the invention in a raised transport position for horizontal transport of the support means on a foundation, illustrated in a first embodiment of the support means.
Figure 2:
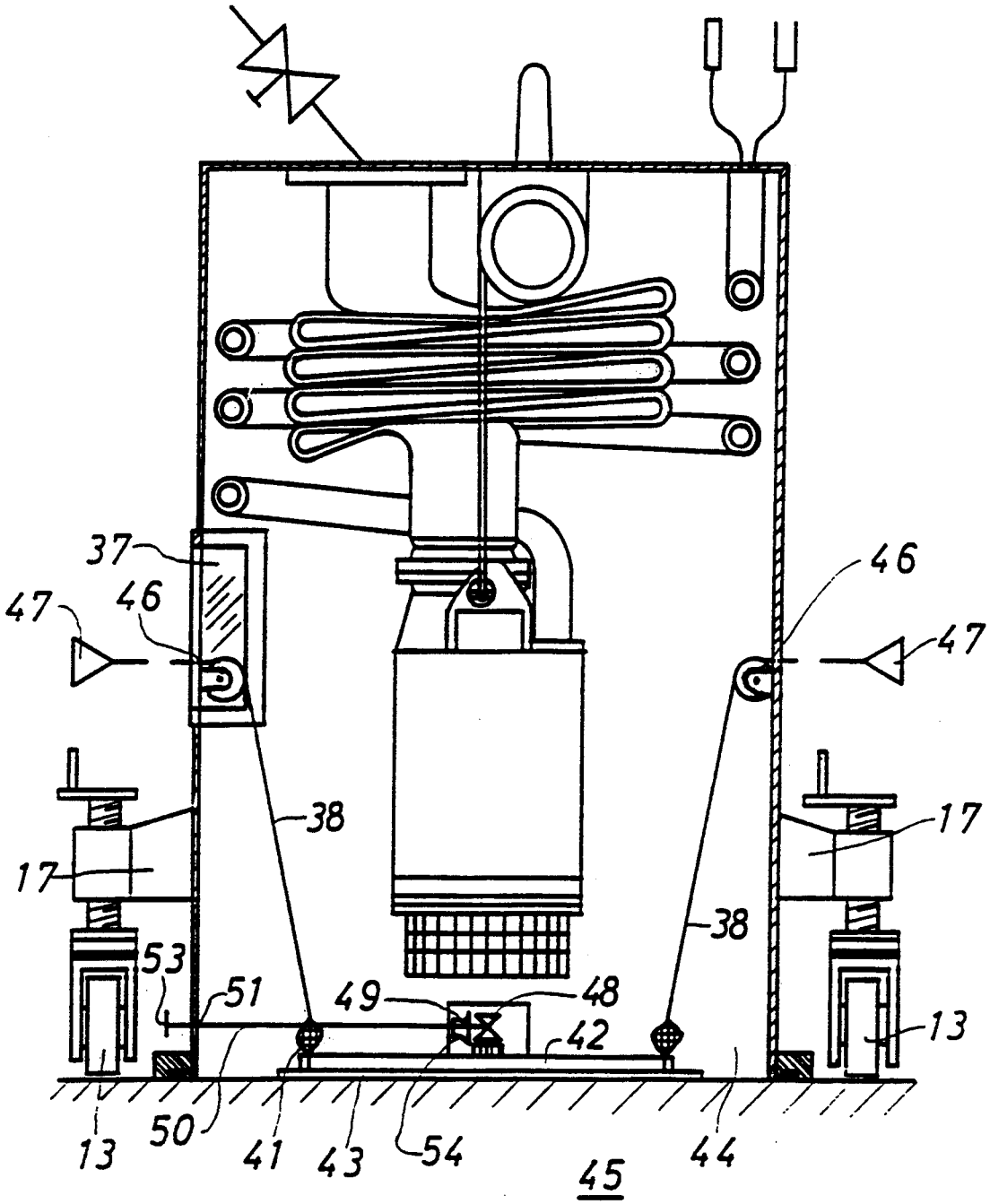
FIG. 2 shows the support means according to FIG. 1 in a lowered down use position, made ready for employment together with a hatch opening.

In FIG. 1, there is shown a foundation 10, such as ship's deck in a tanker 11 (see also FIG. 4), which forms a drive base for four wheels 13 (of which only two wheels are shown herein) belonging to a carriage-forming support means 12, that is to say four wheels 13 which are arranged at suitable mutual intervals along the periphery of the support means 12. Each wheel 13 is supported in a wheel fork 14 which is rotatably mounted in a screw spindle 15. The screw spindle 15 is provided with external screw threads which cooperate with internal screw threads in a vertical support sleeve 16, which is fastened to the support means 12 via a bracket 17 projecting laterally outwards from this. At the upper end of the screw spindle 15 there is shown a hand crank **15*a* for regulating the level of the wheel 13 relative to the support means 12. In FIG. 1, the wheels 13 are shown in the furthest pushed-out position of the wheels for transportation of the support means 12 on the foundation 10 in a correspondingly raised position. In FIG. 2, the wheels are shown in a drawn-in position and raised to a level just above the foundation 10, the support means 12 itself forming a supporting abutment directly against the foundation 10 via a seal 18 fastened to a support flange 19 at the lower edge of the support means 12, with the weight of the support means 12 resting against the foundation via the seal 18**.

The support means 12 is shown in the form of a bell-shaped housing member, hollow space of which is sealed off against atmospheric air by means of the seal 18 between the support means 12 and the foundation 10. In a stored condition, the hollow space of the support means 12 can be sealed off against the foundation, preferably with the support means 12 received in a container 11a (see FIG. 4) on the deck of the tanker 21 and with the support means 12 sealed off against the bottom of the container.

In the illustrated embodiment, the support means 12 is provided with a cylindrical sleeve-shaped, vertical wall 20 and a correspondingly circular, plane and horizontal top 21 and also an open bottom 22 radially within the support flange 19. A hoisting winch 23 is fastened to the underside of the top 21 of the support means 12 with an actuating arm 23*a* and with two wire drums 24 each with its respective hoisting wire 25 (only the one drum and the one hoisting wire are illustrated herein). The hoisting wires 25 are fastened on their respective sides of a pump aggregate 26 to their respective fastenings 26*a* on the pump aggregate.

The pump aggregate 26 contains in a manner known per se a pump which is connected (in a manner not shown further) via a short drive shaft to a hydraulic drive motor (not shown further). An intake 27 of the pump at the lower end of the aggregate is surrounded by an annual sieve 28. An outlet from the pump is shown at the upper end of the aggregate where the aggregate by means of a flange connection 29 is connected up to a lower end 30*a* of a pump hose stump 30. An upper end 30b of the hose stump 30 is connected up to the top 21 of the support means 12 via a flange 31 which forms on the outer side of the support means 12 coupling means for coupling together with a separate pump house (not shown) which can connect the hose stump 30 to a remotely disposed delivery location (for example a ballast tank). In the illustrated example, there is shown a simple connecting flange 31, but if desired a rapid coupling member (not shown further) can be employed instead.

In the drawing there is schematically shown a manually controlled (if desired remotely controlled) closing valve 31*a* for separate, intermittent shutting off of upper end 30*b* of the hose stump 30. Between the ends 30*a* and 30*b* the hose stump 30 is shown folded together in a manner occupying little space, but made ready for putting out of the hose stump 30 parallel to the putting out of the pump aggregate via the hoisting wires 25.

From the drive motor at the upper end of the pump aggregate, a set of hydraulic oil conduits 32, 33 (the one placed internally in the other) extend in a helical coil 34 upwardly to an upper fastening 34a in top 21 of the support means 12. In the drawing there is shown schematically on the outer side of the support means 12 a rapid coupling arrangement 35 for the pressure oil conduit 32 and a rapid coupling arrangement 36 for the return oil conduit 33, for coupling to a respective external pressure oil conduit and return oil conduit (not shown further) connected to an associated drive aggregate in the container 11*a* (FIG. 4) placed at a suitable location on the deck of the tanker 11.

In side wall 20 of the support means there is shown a window 37 for inspection of the contents of the support means 12. At suitable mutually separated locations along the periphery of the support means (shown herein on two diametrically opposite sides internally in the support means) there is illustrated a lifting device in the form of a hoisting line 38, which passes over a stationarily fastened guide castor 39 fastened to the inner side of the support means 12. One end of the hoisting line 38 is fastened (see FIG. 2) by means of a fastening hook 40 to a fastening eye 41 on the periphery of a hatch cover 42, which covers a hatch opening 42*a* (see FIG. 3) which by means of fastening pins and associated lock nuts is connected (in a manner not shown further) to a fastening flange 43 on the top 44 of a tank 45. The end of the hoisting line 38 is led through a gas-sealed and pressure-sealed guide 46 through wall 20 of the support means and is terminated with a hand grip portion 47. The hatch cover 42 is shown in a closed position in FIG. 2 and in an open position in FIG. 3. By suitable tensioning or slackening of the hoisting lines 38, on simultaneous observation through the window 37, it is possible to maneuver the hatch cover relatively easily from closed to open position.

The hatch cover 42 is provided in the middle (or alternatively at its one edge portion) with a closing valve 48 having a conventional hand wheel 49. In FIG. 2, means in the form of an actuating bar 50 is shown which can be lead endways through the wall 20 through a pressure-sealing and gas-sealing guide 51 for engagement with the wheel 49 for opening the valve 48 for pressure balancing of the chamber internally in the support means 12 relative to the hollow space in the tank. On the outer side of the support means 12 the bar 50 is provided with a handle 53 and at the opposite end the bar 50 is provided with a fork portion 54 which is adapted to be brought in engagement with the wheel 49 for turning of the latter by means of the bar 50.

Figure 4:
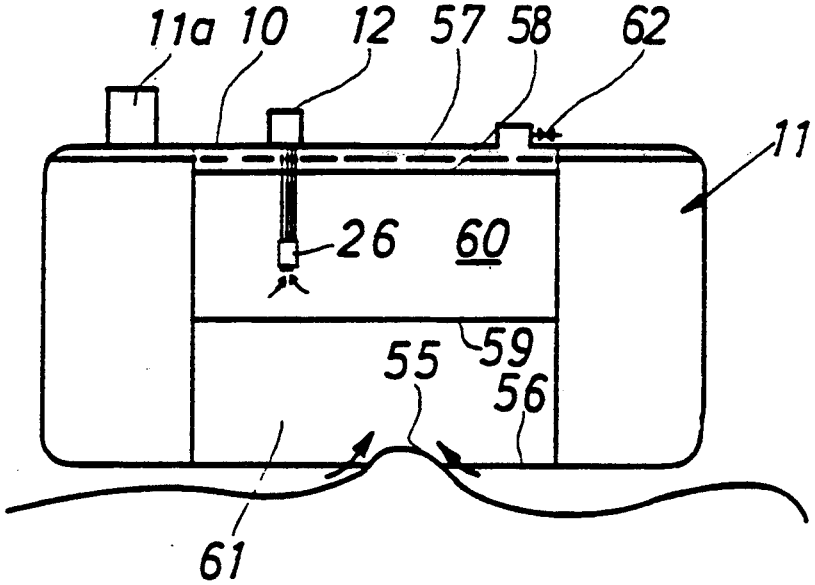
FIG. 4 shows a pump aggregate lowered down in a cargo tank in a tanker, after the cargo tank is damaged and some of the cargo has leaked out of the tank.

The FIG. 4, the pump aggregate 26 is shown submerged in the tank fluid, that is to say, for example, in the oil cargo, after running aground with associated holes 55 in bottom 56 of the tanker 11. By broken lines 57 there is shown the level of the oil cargo prior to the running aground and by full-drawn lines 58 there is shown the level of the oil cargo 66 after a momentary leakage of a quantity of oil cargo 60 has taken place from the damaged tank. By means of a full-drawn line a lower division 59 is shown between the oil cargo 60 and a water plug 61 which has penetrated inwardly into the ship's tank to compensate for a quantity of oil cargo which is pumped from the damaged tank to an available ballast tank or-the like. A regulating valve 62 is provided on the tanker 11 for the supply of neutral gas under excess pressure to the space above the oil cargo 60 in the tank.

In use, the mobile sluice arrangement formed of the support means 12 is rolled by means of the wheels 13 to a position over a hatch so that the hatch cover 42 is disposed within the housing member 20. As indicated FIG. 2, the housing member 20 is disposed in sealed relation relative to the hatch via the seal 18. Thereafter, the externally operated means, that is, the rod 50 is manipulated for opening the valve 48 in the hatch cover 42 so as to communicate the interior of the hatch with the interior of the housing member 20 so as to equalize the pressure therebetween.

Figure 3:
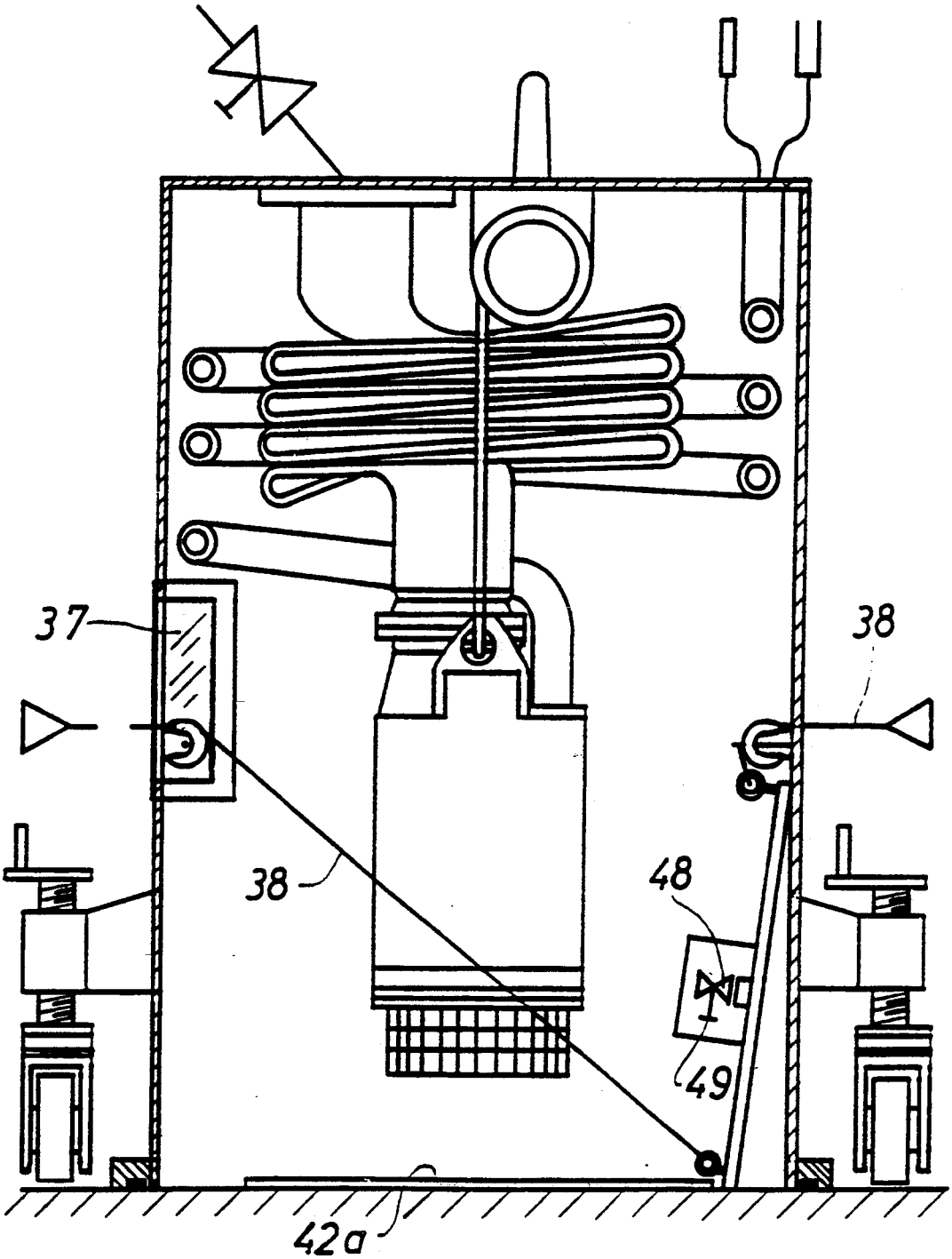
FIG. 3 shows the support means according to FIG. 1 after the hatch cover is removed from the hatch opening.

Thereafter, the externally operated lifting means 38 are manipulated for raising the hatch cover 42 from the hatch, for example, into a position as shown in FIG. 3. The pump aggregate 26 can then be lowered via the hoisting winch 23 into the hatch. During this time, the hose stump 30 is unfolded while the hydraulic oil conduits 32, 33 likewise uncoil.

Figure 5:
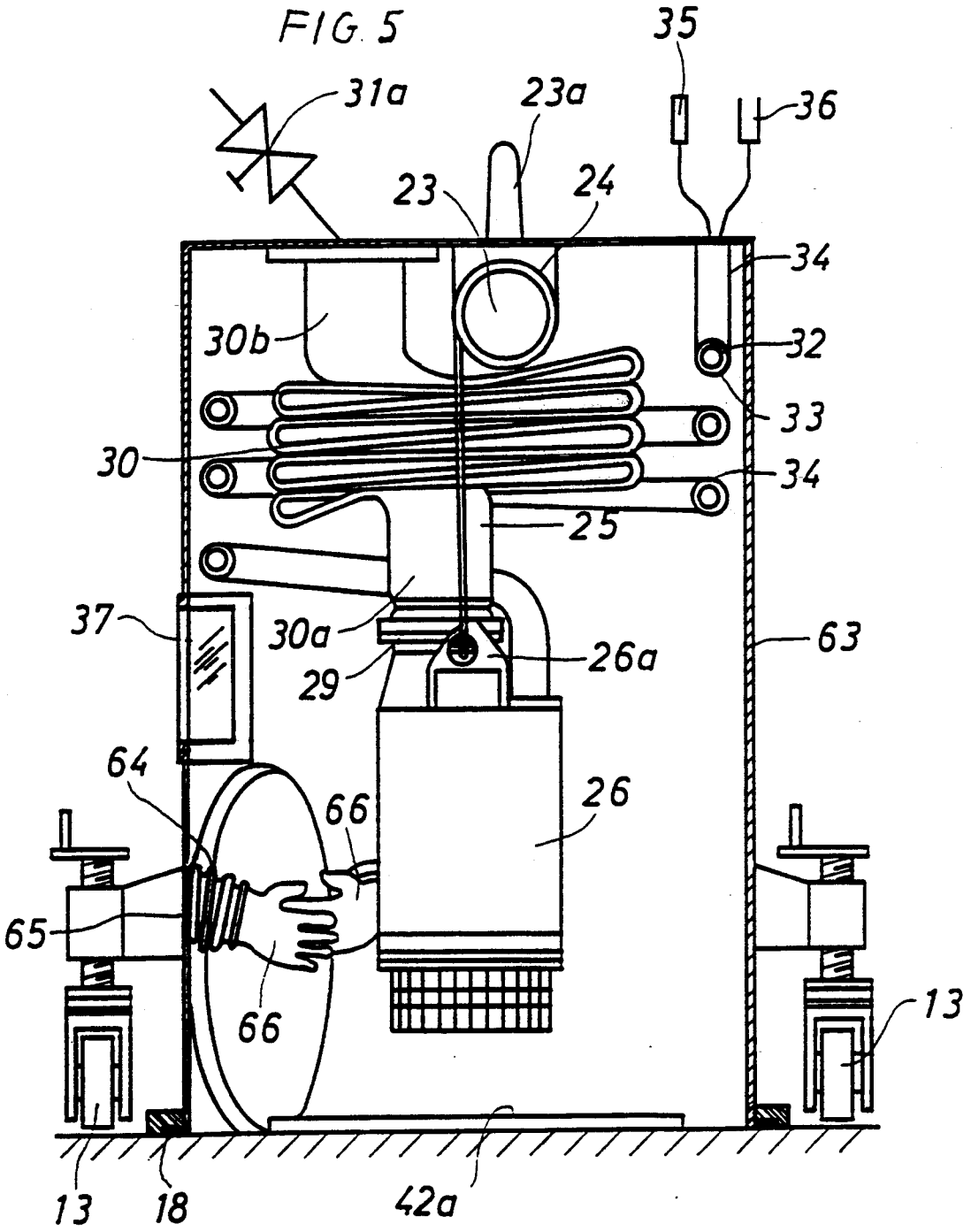
FIG. 5 shows a support means according to the invention according to a second embodiment, illustrated in a corresponding condition as shown in FIG. 3.

In FIG. 5, a modified support means 63 is shown of the support means 12 which is illustrated in FIG. 1–3. The most significant difference consists in that the hoisting lines 38 according to FIG. 1–3 are replaced by a pair of braced, longitudinally elastic, linked work sleeves 64, one end of which has an opening 65 which is uncovered to atmospheric air and which is accessible to the introduction of an operator's hand and arm to the bottom of the work sleeve where the latter is terminated with a braced, somewhat elastic, linked glove portion 66. The operator can via the work sleeves 64 grip around and upwardly raise the hatch cover and also swing the latter into place in the illustrated uncovered position as shown in FIG. 5. In addition, one can be means of the work sleeves open the valve on the hatch cover and if necessary operate extra tools (not shown further) which are introduced into the support means 63 prior to the placing of the latter around the adjacent hatch opening.

It is claimed:

1. In combination a support means defining a housing member with an open bottom for disposition over a hatch of a tank and at least one coupling means in a top thereof;

a pump aggregate disposed within said housing member and including an intake at a lower end and an outlet disposed in an upper end;

a hose stump connected to and between said outlet of said pump aggregate and said coupling means for conveying medium therebetween;

a pair of flexible hydraulic conduits disposed within said housing member, said conduits being connected to said pump aggregate;

a pair of coupling arrangements on said housing member for respective coupling to said hydraulic conduits; and a hoisting winch disposed within said housing member for lower of said pumps aggregate therefrom into a hatch of a tank.

2. The combination as set forth in claim 1 wherein said support means includes a plurality of wheels for moving said housing member to and from a hatch and means for raising and lowering said wheels relative to said housing member.

3. The combination as set forth in claim 1 wherein said housing member is of cylindrical shape.

4. The combination as set forth in claim 1 wherein said support means has a seal disposed about said open bottom.

5. The combination as set forth in claim 1 which further comprises externally operated lifting devices within said housing member for raising a hatch cover from a hatch disposed below said housing member.

6. In combination, a tanker having at least one hatch for receiving liquid cargo under pressure;

a hatch cover removably mounted over said hatch and a valve in said hatch cover in selective communication with said hatch;

a mobile housing member having an open bottom disposed over said hatch in sealed relation thereto and in spaced relation about said hatch cover;

externally operated means within said housing member for opening said valve in said hatch cover to communicate said hatch with the interior of said housing member;

externally operated lifting means within said housing member for raising said hatch cover from said hatch;

a pump aggregate disposed within said housing member; and a hoisting winch disposed within said housing member for lowering said pump aggregate into said hatch with said hatch cover in a raised position.

7. The combination as set forth in claim 6 wherein said pump aggregate includes an intake at a lower end and an outlet at an upper end and which further comprises a hose stump connected to said outlet, a coupling means on said housing member coupled to said hose stump, a pair of hydraulic conduits connected to said pump aggregate and a pair of coupling arrangements on said housing member for respective coupling to said hydraulic conduits.

8. A process for guiding and submerging a pump aggregate in a fluid in a tank, said process comprising the steps of suspending a pump aggregate from and within a support means, said pump aggregate including a pump, a drive motor connected to the pump, a hose stump connected to the pump and disposed in folded manner in said support means, and a set of hydraulic conduits connected between said drive motor and said support means;

positioning the support means in gas-sealed and pressure tight relation outside and concentrically about a hatch opening; and winching the suspended pump aggregate downwardly through the hatch opening from within the support means while maintaining the pump aggregate in gas-sealed and pressure tight relation within the support means.

9. A system for guiding and submerging a pump aggregate in a fluid in a tank, said system comprising a support means for positioning outside and concentrically about a hatch opening in gas-sealed and pressure tight relation;

a pump aggregate including a pump, a drive motor for said pump, a hose stump connected to and between said support means and said pump and a set of hydraulic conduits connected to and between said drive motor and said support means; and a hoisting winch within said support means for moving said pump aggregate into and through the hatch opening.

* * * * *

UNITED STATES PATENT AND TRADEMARK OFFICE

CERTIFICATE OF CORRECTION

PATENT NO. : 5,400,732
DATED : March 28, 1995
INVENTOR(S) : Magne Olav Berge

It is certified that error appears in the above-indentified patent and that said Letters Patent is hereby corrected as shown below:

Column 2, line 5 change "Accordingly," to --According--

Column 3, line 12 change "The" to --the--

Column 5, line 2 after "housing member," insert --the--

Column 7, line 40 change "lower of said pumps" to --lowering of said pump--

Signed and Sealed this

First Day of August, 1995

Bruce Lehman

*Attest:*

BRUCE LEHMAN

*Attesting Officer*

*Commissioner of Patents and Trademarks*